US008863715B2

(12) United States Patent
Schuseil et al.

(10) Patent No.: US 8,863,715 B2
(45) Date of Patent: Oct. 21, 2014

(54) INTERNAL COMBUSTION ENGINE HAVING TWO LUBRICATING CHAMBERS SEPARATED FROM ONE ANOTHER IN A FLUID-TIGHT MANNER

(75) Inventors: Bolko Schuseil, Adelsdorf (DE); Lajos Farkas, Weisendorf (DE); Klaus Hahn, Furth-Burgfarrnbach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/583,966

(22) PCT Filed: Mar. 29, 2011

(86) PCT No.: PCT/EP2011/054788
§ 371 (c)(1),
(2), (4) Date: Sep. 11, 2012

(87) PCT Pub. No.: WO2011/124500
PCT Pub. Date: Oct. 13, 2011

(65) Prior Publication Data

US 2013/0000579 A1 Jan. 3, 2013

(30) Foreign Application Priority Data

Apr. 6, 2010 (DE) ..... 10 2010 013 927

(51) Int. Cl.

| | |
|---|---|
| ***F01M 9/10*** | (2006.01) |
| ***F01L 1/02*** | (2006.01) |
| ***F01M 11/02*** | (2006.01) |
| ***F01L 9/02*** | (2006.01) |
| *F01L 1/344* | (2006.01) |

(52) U.S. Cl.
CPC .. *F01L 1/02* (2013.01); *F01M 9/10* (2013.01); *F01L 2810/02* (2013.01); *F01M 11/02* (2013.01); *F01L 1/022* (2013.01); *F01L 9/025* (2013.01); *F01L 2001/34446* (2013.01); *F01L 1/024* (2013.01)
USPC ..... 123/90.38; 123/90.31; 184/11.5

(58) Field of Classification Search
USPC ..... 123/90.38, 90.33, 90.31, 90.17; 184/11.5, 15.1, 15.2; 474/146
See application file for complete search history.

(56) References Cited

U.S. PATENT DOCUMENTS

| | | | | |
|---|---|---|---|---|
| 3,641,990 | A | 2/1972 | Kinnersly | |
| 4,756,280 | A | 7/1988 | Tamba et al. | |
| 5,267,537 | A * | 12/1993 | Suzuki et al. | 123/90.38 |
| 6,199,523 | B1 * | 3/2001 | Neubauer et al. | 123/90.15 |
| 6,349,687 | B2 * | 2/2002 | Endeward | 123/90.31 |
| 2002/0035982 | A1 | 3/2002 | Kobayashi et al. | |
| 2002/0056428 | A1 | 5/2002 | Ito et al. | |

FOREIGN PATENT DOCUMENTS

| | | |
|---|---|---|
| DE | 3029964 | 1/1983 |
| DE | 4244052 | 7/1993 |
| EP | 0931912 | 7/1999 |
| EP | 1477635 | 11/2004 |
| EP | 2060754 | 5/2009 |
| GB | 1107793 | 3/1968 |

* cited by examiner

*Primary Examiner* — Zelalem Eshete
(74) *Attorney, Agent, or Firm* — Volpe and Koenig, P.C.

(57) ABSTRACT

An internal combustion engine (1) having a crankshaft (2), having at least one camshaft (12) for actuating gas exchange valves (15, 104), and having a synchronous drive (9) which transmits the rotation of the crankshaft (2) to the camshaft (12), wherein the crankshaft (2) is arranged predominantly in the first chamber (6) which is separated in a fluid-tight manner from a second chamber (8) in which the synchronous drive (9) is arranged, wherein the camshaft (12) is also arranged in the second chamber (8).

10 Claims, 2 Drawing Sheets

INTERNAL COMBUSTION ENGINE HAVING TWO LUBRICATING CHAMBERS SEPARATED FROM ONE ANOTHER IN A FLUID-TIGHT MANNER

FIELD OF THE INVENTION

The invention relates to an internal combustion engine having a crankshaft, at least one camshaft for actuating gas exchange valves, and a synchronous drive, which transmits the rotation of the crankshaft to the camshaft, wherein the crankshaft is arranged predominantly in a first chamber, which is separated in a fluid-tight manner from a second chamber, in which the synchronous drive is arranged.

BACKGROUND

Internal combustion engines are used to provide a source of power in motor vehicles, such as automobiles, trucks and other terrestrial vehicles. Such internal combustion engines are also used, however, in watercraft or terrestrial vehicles.

Internal combustion engines often comprise one or more cylinders, in which pistons are made to reciprocate by an explosive combustion of fuels, such as diesel or petrol fuel. The movement of one or more connecting rods resulting from combustion of the fuels is transmitted to at least one crankshaft.

In order to be able to introduce fuel into the interior of the cylinder and to carry combustion residues out of the cylinder, gas exchange valves are provided, which are capable of closing intake ports and exhaust ports in the cylinder according to the port timing. Such gas exchange valves are activated directly or indirectly. A camshaft, the cams of which act on the respective valve, is often used. The alternative or additional use of electronic components, such as piezoelectric crystals, in order to pin-point an optimum port timing remains optional. The camshaft is basically connected to the crankshaft in such a way that the movement of the crankshaft influence by means of the camshaft controls the opening or closing of the gas exchange valves.

For this purpose the system presented in EP 0 931 912 A1 provides a variable timing of the opening of the inlet and exhaust valves without changing the mechanical parts which control the displacement of the valves. Whereas in a conventional timing adjustment system the movement of each inlet or exhaust valve is clearly defined by the geometry of the mechanical parts driving the valve, in the known system described above the solenoid valve, which controls the pressurized chamber associated with a given valve, can actually be impelled to open at any time, in such a way as to drain the aforementioned chamber of pressurized oil, thereby bringing about the rapid closure of the inlet or exhaust valve under the action of the corresponding return spring means, even during a phase in which the corresponding cam would have kept the valve open.

Among other things, vertical shafts or continuous drives are used in order to establish a connection between the crankshaft and the camshaft. In modern internal combustion engines, which are used particularly in automobiles, continuous drive means, such as those used in traction drives, have gained acceptance. The means of traction used here are usually continuous drive means in the nature of a chain or a toothed belt.

Use of the traction drive to drive a further unit is also known. In this case such a unit may be an injection pump and/or a balancer shaft.

Such traction drives which are used in controlling internal combustion engines are known in the state of the art.

In older internal combustion engines a single fluid, which is also used for lubricating the traction drive and the camshaft, has hitherto been used for lubricating the crankshaft, the connecting rods and the pistons in the cylinders.

It is extremely important that the camshaft should remain synchronized with the crankshaft and that no synchronization defects should occur. This happens, for example, if the means of traction stretches, which may be attributable to increased wear. In extreme cases this even leads to complete failure of the means of traction. This problem also arises if the means of traction is embodied as a timing chain. For this reason there has been a longstanding desire to increase the service life of a means of traction, such as a timing chain.

For this purpose DE 4244052 C2, which is regarded as the generic state of the art, discloses a device for lubricating a power transmission chain in an internal combustion engine. This printed patent specification discloses the transmission of a rotational movement of a crankshaft to a camshaft by means of a chain, wherein a part of each shaft in each case extends through a crankshaft chamber or camshaft chamber containing lubricating oil and wherein the chain is enclosed by a chain case containing lubricating oil, shaft seals being intended to prevent a direct flow of lubricating oil both from the camshaft chamber and from the crankshaft chamber into the interior of the chain case, so that a lubricating oil with a low level of contamination is provided in the chain case.

Use of the very latest engines has revealed, however, that such combustion processes generate even more oil contamination in a shorter space of time, which has effects not only on the means of traction, such as timing chains, but also on the camshaft. In particular, the escape of soot particles (especially from the combustion of fuel in diesel engines), which are dissolved or flushed into the engine oil surrounding the pistons and the crankshaft, gives rise to considerable problems in the operation of conventional, modern internal combustion engines. The solution demonstrated in DE 3029964 C2 for a method of lubricating a diesel internal combustion engine also fails to solve this problem completely.

SUMMARY

The object of the present invention is therefore to eliminate the existing problems and to provide a more durable synchronous drive.

According to the invention this object is achieved in that the camshaft is also arranged in the second chamber.

In this way a second chamber, separated from lubricating fluid contained in the first chamber, is provided, so that the lubrication performed in the second chamber by the fluid present therein is independent of the pressure in the first chamber. This means that mechanically or hydraulically functioning tensioning and damping elements independent of the pressure in the first chamber can advantageously be used. The overall size of the means of traction can be reduced, which leads to a reduction of the moments of mass and inertia of the overall system. Furthermore the tension in the means of traction can then be reduced, which has a beneficial effect on the friction and noise behavior of the overall system. The means of traction and the camshaft furthermore then move in fluid suited to these two means of motion, so that, for example, timing gear oils with special additives can be used in the second chamber, in order to take account of the similar basic conditions prevailing there, whereas in the first chamber an engine oil with different additives can be used for the different basic conditions prevailing there.

Advantageous embodiments are claimed in the dependent claims and are explained in more detail below.

In a preferred development of the invention the synchronous drive is embodied as a traction drive having a chain and/or a belt as a traction element. If the traction element is embodied as a chain, this results in longer maintenance intervals than in the case of alternative traction element. If the traction element is embodied as a belt drive, on the other hand, more cost-effective solutions can be implemented. By leading the toothed belt in oil, numerous advantages accrue in terms of noise emissions and costs, which are also set forth separately in parallel patent applications. The material used for the toothed belt, however, must be oil-resistant for this application.

In a further embodiment according to the invention the synchronous drive is embodied as a spur gear drive, since in this case all additional components, which are needed to guide and tension the means of traction in a traction drive, are eliminated.

In implementing the invention it is proposed that at least one camshaft should comprise a camshaft adjuster, which serves for adjusting the port timings in the valve drive, at at least one of its ends. Here the camshaft adjuster may be arranged both on an intake camshaft and on an exhaust camshaft.

It is also advantageous if the camshaft interacts with gas exchange valves, which open or close one or more intake and/or exhaust ports of a combustion chamber in one or more cylinders, the gas exchange valves comprising stems which are guided in a fluid-tight manner. In this way the second chamber may be kept separated in a fluid-tight manner from the first chamber also in a cylinder head area. This also helps to avoid stretching due to wear, particularly when timing chains are used, and to ensure that the increased oil contamination in the cylinder and crankshaft chamber, which in modern combustion processes occurs in a shorter space of time, does not have negative effects on the camshaft and the traction drive.

The camshaft may optionally actuate at least one of the gas exchange valves by means of an electro-hydraulic variable valve timing. The operating principle of the hydraulic gas exchange valve gear known in the art briefly relies on a high-pressure chamber acting as a hydraulic linkage between an input unit and an output unit, the hydraulic volume, displaced by a pump tappet and proportional (disregarding leakages) to the lift of a cam, being divided as a function of the opening time and the opening period of a hydraulic valve into a first partial volume impinging on an output piston, and a second partial volume flowing out into a medium-pressure chamber including pressure accumulator. As a result, the lift transmitted to the output piston by the pump tappet and therefore not only the port timings but also the lifting height of the gas exchange valve are fully variably adjustable.

The movement of the crankshaft must naturally be transmitted to the camshaft; this can be achieved by means of a traction drive or a spur gear drive. It is therefore advantageous if the crankshaft comprises an end portion which extends into the second chamber and which is sealed off by a shaft seal, so that a first fluid of the first chamber acting as lubricant is separated from a second fluid of the second chamber acting as lubricant.

In a further variant it is furthermore advantageous if the first fluid has different characteristics from the second fluid, particularly with regard to the viscosity and/or the temperature resistance, possibly owing to the addition of additives. Through corresponding addition of such additives it is possible to adapt each of the two fluids to the special basic conditions in the first chamber or second chamber. The service life of the internal combustion engine and of the traction drive contained therein is thereby considerably increased and the maintenance intervals are considerably extended.

In order to enhance the ease of repair, it is advantageous if a fluid separation of the two fluids into the first chamber and the second chamber is achieved through exchangeable friction seals. Should one of the seals sustain a leakage, a rare replacement of this is possible, thereby affording a return to defect-free operation. It is also advantageous if the first fluid and the second fluid take the form of oily liquids, since such liquids, such as mineral oils, can be very finely matched to the respective requirements and can be changed separately after different maintenance intervals.

The production and assembly of the internal combustion engine can be optimized if the first chamber and the second chamber are arranged in a common housing or block.

It is also advantageous if the means of traction is arranged running in a plane which is perpendicular to the axes of the camshaft and the crankshaft. In this way it is possible to design internal combustion engines which take up only a relatively small overall space.

It is also advantageous if the means of traction is in power-transmitting effective contact with an auxiliary unit, such as an injection pump or a balancer shaft.

Advantages accrue, particularly where timing chains are used, in terms of the durability, thermal resistance and the reduction of maintenance intervals. In an inventive configuration of the internal combustion engine it is also to use low-noise toothed chains, which leads to a reduction of noise emissions. In this way it is possible to meet high noise emission and $CO_2$ emission specifications. Compact designs of internal combustion engines are then also simultaneously feasible in conjunction with high thermal resistance.

BRIEF DESCRIPTION OF THE DRAWINGS

The invention is explained in more detail below with the aid of two drawings, of which.

DETAILED DESCRIPTION OF THE PREFERRED EMBODIMENTS

Figure 1:
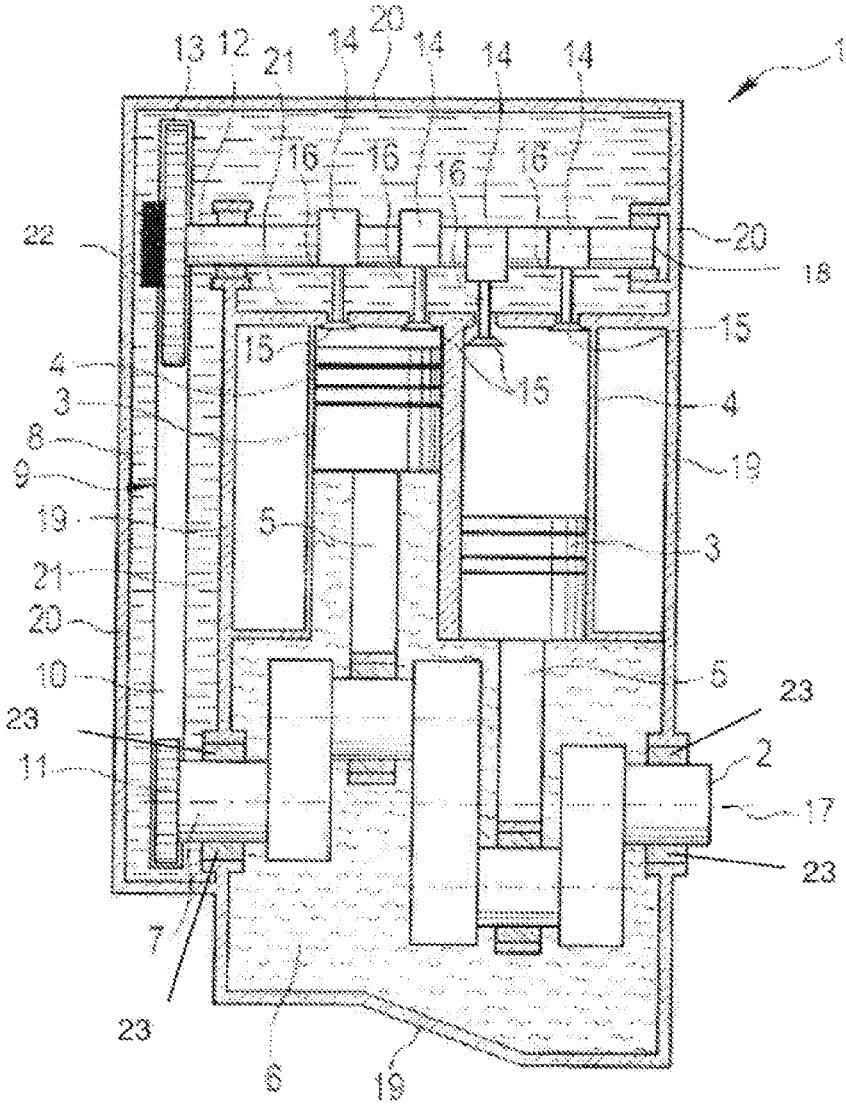
FIG. 1 shows the schematic construction of an internal combustion engine in section, with two separated lubricating chambers, one containing the crankshaft, the connecting rods and the pistons and the other containing the camshaft and the timing gear moveable by the means of traction

The representation of the internal combustion engine 1 in FIG. 1 is merely of a schematic nature and serves only for an understanding of the invention.

The internal combustion engine 1 comprises a crankshaft 2, which here is driven by two pistons 3, for example. The two pistons 3 represented in FIG. 1 are arranged so that they are linearly moveable in two cylinders 4. The drawing does not show that the cylinders 4 also contain cylinder liners. The movement of the pistons 3 is transmitted to the crankshaft 2 by connecting rods 5. The connecting rod bearings are sufficiently known and are merely indicated.

The bearings of the crankshaft 2 are also merely indicated.

The crankshaft 2 is predominantly arranged in a first chamber 6. Only a small end portion 7 of the crankshaft 2 extends out of the first chamber 6 into a second chamber 8. A synchronous drive 9 is also provided in the second chamber 8. The synchronous drive 9 comprises a traction element 10, which is in effective contact with a sprocket wheel 11. The sprocket wheel 11 is attached to the end portion 7 of the crankshaft 2.

The traction element 10, which in the exemplary embodiment represented in FIG. 1 is a timing chain in the nature of a chain having individual steel links, is also in power-transmitting effective contact with a further sprocket wheel 13 attached to a camshaft 12. The camshaft 12 comprises individual cams 14, which act on gas exchange valves 15. On their side facing the camshaft the gas exchange valves 15 comprise stems 16. The individual cams 14 therefore produce a movement of the stems 16 and thereby of the gas exchange valves 15, so that inlet or exhaust ports are opened or closed.

The sprocket wheels 11 and 13 may be embodied as chain-drive sprockets or toothed belt pulleys.

Such a movement is caused by a rotation of the crankshaft 2 about the axis 17, the movement of the crankshaft 2 being transmitted to the individual cams 14 via the sprocket wheel 11, the traction element 10, the sprocket wheel 13 and the camshaft 12, so that their movement causes a deflection of the stems 16. In so doing the camshaft 12 rotates about an axis 18.

A fluid seal, such as a friction seal in the nature of a shaft seal (23) is arranged in the area of the end portion 7, but is not explicitly shown in FIG. 1. Also provided on the side opposite the end portion 7 is a corresponding shaft seal (23), so that that fluid contained in the first chamber 6 cannot escape therefrom. For this purpose the stems 16 are also sealed. These seals, too, are not shown. The individual seals and a first housing 19 enclosing the chamber 6 ensure that the fluids in the first chamber 6 and the second chamber 8 remain separated from one another. The intake and exhaust lines for the fuel burned in the combustion chambers, the inlet air and the resulting exhaust gases are not shown, but are present in the area of the gas exchange valves 15. At its end extending into the second chamber 8, the camshaft 12 furthermore comprises a camshaft adjuster 22, which serves for adjusting the port timings in the valve drive.

The fluid contained in the second chamber 8 remains accommodated between a second housing 20 and a portion 21 of the first housing 19 acting as a dividing wall.

The different fluids in the first chamber 6 and in the second chamber 8 are denoted by different symbols. The first chamber 6 contains a liquid, in particular a liquid mineral oil serving as engine oil.

The second chamber 8 contains a similar liquid, such as a timing gear oil, which is likewise mineral oil-based, but which has different additives, a different viscosity and/or a different temperature resistance from the engine oil.

The timing gear oil may be contained in a different circuit from the engine oil.

It is possible for the traction element 10, such as a timing chain, to drive not just a single camshaft 12 but two or more camshafts 12, for example in the case of a V-cylinder arrangement. It is furthermore possible for the traction element 10 to be alternatively or additionally in power-transmitting effective contact with a further unit, such as a generator or an alternator.

Figure 2:
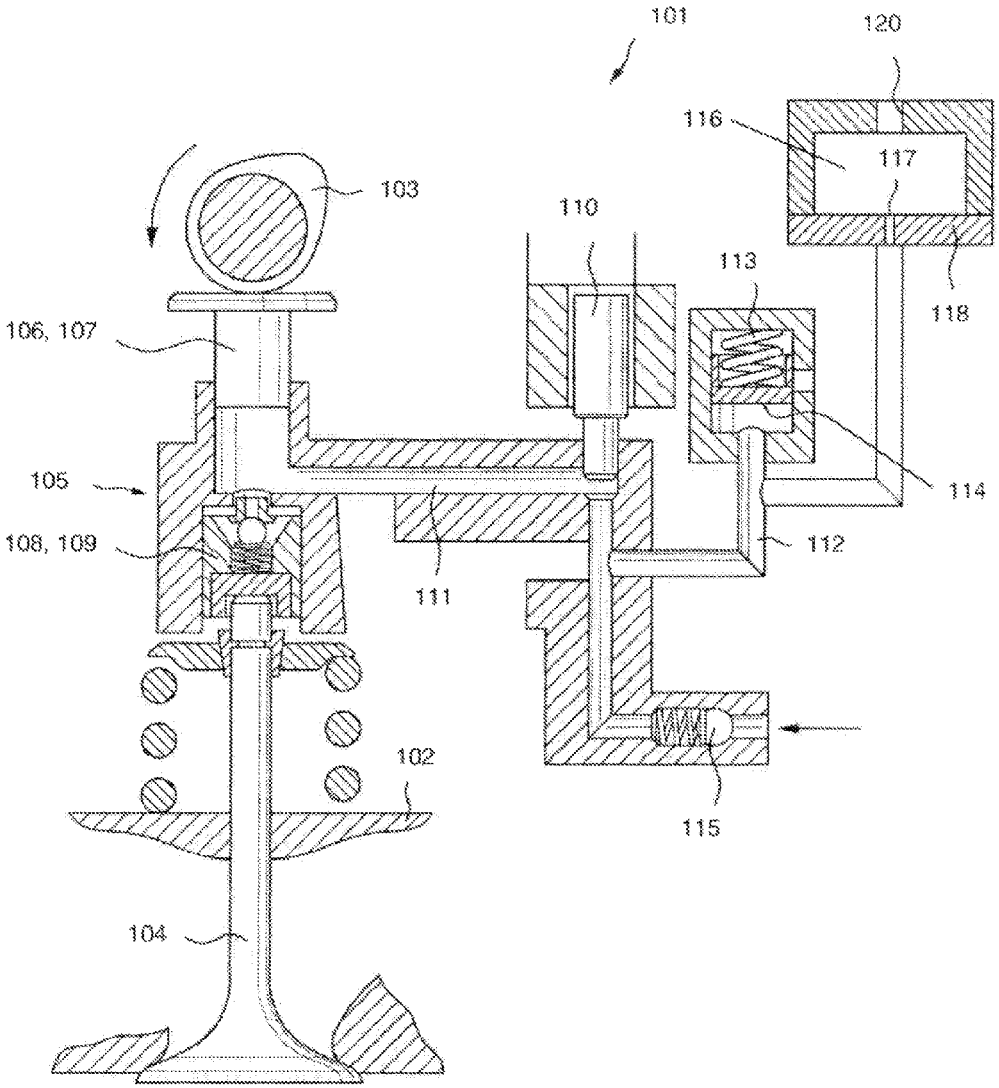
FIG. 2 shows a schematic representation of an electro-hydraulically variable gas exchange valve gear.

The basic construction of a hydraulically variable gas exchange valve drive 101 is represented schematically in FIG. 2. This shows a of a cylinder head 102 of an internal combustion engine with a cam 103 of a camshaft and a gas exchange valve 104 spring-loaded in a closing direction. The variability of the gas exchange valve drive 101 is produced by means of a hydraulic unit 105, which is arranged between the cam 103 and the gas exchange valve 104 and which comprises the following components:

a drive-side input unit 106, here in the form of a pump tappet 107 driven by the cam 103, a driven-side output unit 108, here in the form of a output piston 109 directly actuating the gas exchange valve 104, a controllable hydraulic valve 110, here in the form of a solenoid, normally open 2/2-way switching valve, a high-pressure chamber 111, which runs in the direction in which the cam lift 103 is transmitted to the gas exchange valve 104, between the input unit 106 and the output unit 108, and from which hydraulic fluid can flow into a medium-pressure chamber 112 when the hydraulic valve 110 is opened, a pressure accumulator 113, connected to the medium-pressure chamber 112 and having a spring-loaded balancer piston 114, a non-return valve 115 opening in the direction of the medium-pressure chamber 112 and via which the hydraulic unit 105 is connected to the central hydraulic circuit of the internal combustion engine, and a low-pressure chamber 116, which serves as hydraulic fluid reservoir and which is situated (in the arrowed direction of acceleration due to gravity g) geodesically above the medium-pressure chamber 112 and the high-pressure chamber 111, and which is connected to the medium-pressure chamber 112 via a restriction 117 in a dividing wall 118 separating the low-pressure chamber 116 from the medium-pressure chamber 112.

The low-pressure chamber 116 is provided with an overflow 120 opening into the cylinder head 102. This overflow serves not only for venting of the low-pressure chamber 116, but also for cooling the hydraulic unit 115, in that heated hydraulic fluid can escape into the cylinder head 102 via the low-pressure chamber 116 and can consequently be returned into the cooled central hydraulic circuit of the internal combustion engine.

LIST OF REFERENCE NUMERALS

1 internal combustion engine
2 crankshaft
3 piston
4 cylinder
5 connecting rod
6 first chamber
7 end portion
8 second chamber
9 synchronous drive
10 traction element
11 sprocket wheel
12 camshaft
13 sprocket wheel
14, 103 cam
15, 104 gas exchange valve
16 stem
17 axis (of crankshaft)
18 axis (of camshaft)
19 first housing
20 second housing
21 portion
22 camshaft adjuster
101 gas exchange valve drive
23 shaft seal
102 cylinder head
105 hydraulic unit
106 input unit
107 pump tappet
108 output unit

109 output piston
110 hydraulic valve
111 high-pressure chamber
112 medium-pressure chamber
113 pressure accumulator
114 balancer piston
115 non-return valve
116 low-pressure chamber
117 restriction
118 dividing wall
120 overflow

The invention claimed is:

1. An internal combustion engine comprising a crankshaft, at least one camshaft for actuating gas exchange valves, and a synchronous drive, which transmits a rotation of the crankshaft to the camshaft, the crankshaft is arranged predominantly in a first chamber, which is separated in a fluid-tight manner from a second chamber which completely surrounds both the synchronous drive and the camshaft.

2. The internal combustion engine as claimed in claim 1, wherein the synchronous drive is embodied as a traction drive having at least one of a chain or a belt as a traction element.

3. The internal combustion engine as claimed in claim 1, wherein the synchronous drive is a spur gear drive.

4. The internal combustion engine as claimed in claim 1, wherein the at least one camshaft comprises a camshaft adjuster at at least one of its ends.

5. The internal combustion engine as claimed in claim 1, wherein the camshaft actuates at least one of the gas exchange valves by an electro-hydraulic variable valve timing.

6. The internal combustion engine as claimed in claim 1, wherein the crankshaft comprises an end portion which extends into the second chamber and which is sealed off by a shaft seal, so that a first fluid of the first chamber acting as lubricant is separated from a second fluid of the second chamber acting as lubricant.

7. The internal combustion engine as claimed in claim 6, wherein the first fluid has different characteristics from the second fluid.

8. The internal combustion engine as claimed in claim 6, wherein the fluid separation of the two fluids is achieved by shaft seals, which are embodied as exchangeable friction seals.

9. The internal combustion engine as claimed in claim 1, wherein the first chamber and the second chamber are arranged in a common housing or block.

10. The internal combustion engine as claimed in claim 2, wherein the traction element is arranged running in a plane which is perpendicular to axes of the camshaft and the crankshaft.

* * * * *